US009708112B2

(12) United States Patent
Sutherland et al.

(10) Patent No.: US 9,708,112 B2
(45) Date of Patent: Jul. 18, 2017

(54) CARRIER FOR CONTAINERS

(71) Applicant: Graphic Packaging International, Inc., Atlanta, GA (US)

(72) Inventors: Robert L. Sutherland, Kennesaw, GA (US); Mark Zammit, Douglasville, GA (US); Colin P. Ford, Woodstock, GA (US); Kevin T. May, Kennesaw, GA (US)

(73) Assignee: Graphic Packaging International, Inc., Atlanta, GA (US)

( * ) Notice: Subject to any disclaimer, the term of this patent is extended or adjusted under 35 U.S.C. 154(b) by 140 days.

(21) Appl. No.: 14/591,236

(22) Filed: Jan. 7, 2015

(65) Prior Publication Data

US 2015/0191284 A1 Jul. 9, 2015

Related U.S. Application Data

(60) Provisional application No. 61/964,519, filed on Jan. 7, 2014.

(51) Int. Cl.
*B65D 71/20* (2006.01)
*B65B 5/02* (2006.01)
(Continued)

(52) U.S. Cl.
CPC ..... *B65D 71/20* (2013.01); *B65D 5/4608* (2013.01); *B65D 71/22* (2013.01); *B65D 71/243* (2013.01);
(Continued)

(58) Field of Classification Search
CPC ..... B65D 71/20; B65D 5/4608; B65D 71/22; B65D 71/243; B65D 71/32;
(Continued)

(56) References Cited

U.S. PATENT DOCUMENTS 1,968,877 A * 8/1934 Cubberley ..... B65D 71/20 206/140
2,289,859 A 7/1942 Arthur
(Continued)

FOREIGN PATENT DOCUMENTS

AR 7877 12/2008
EP 0 024 782 A1 3/1981
(Continued)

OTHER PUBLICATIONS

International Search Report and Written Opinion for PCT/US2015/010421 dated Apr. 24, 2015.

*Primary Examiner* — Chun Cheung
(74) *Attorney, Agent, or Firm* — Womble Carlyle Sandridge & Rice, LLP

(57) ABSTRACT

A carrier for holding a plurality of articles. The carrier comprises a plurality of panels that extends at least partially around an interior of the carton. The plurality of panels can comprise a first top panel foldably connected to a second top panel and a back panel. The second top panel can be oblique with respect to the first top panel and the back panel. A crown retention feature can be in the back panel adjacent the first top panel for at least partially receiving a top portion of a first article of the plurality of articles. A crown receiving opening can be in the second top panel spaced apart from the first top panel for at least partially receiving a top portion of a second article of the plurality of articles so that the top portion of the second article extends at least partially through the crown receiving opening.

43 Claims, 6 Drawing Sheets

(51) Int. Cl.
*B65D 5/468* (2006.01)
*B65D 71/32* (2006.01)
*B65D 71/22* (2006.01)
*B65D 71/24* (2006.01)

(52) U.S. Cl.
CPC ..... *B65D 71/32* (2013.01); *B65D 2571/0066* (2013.01)

(58) Field of Classification Search
CPC .. B65D 2571/0066; B65D 71/38; B65D 5/42; B65D 5/5026; B65D 74/36
USPC ..... 206/434, 427; 229/122, 103, 103.2
See application file for complete search history.

(56) References Cited

U.S. PATENT DOCUMENTS 2,345,567 A 4/1944 Arneson
2,384,480 A 9/1945 Lupton
2,417,421 A 3/1947 Koolnis
2,522,950 A 9/1950 Keith
2,558,618 A 6/1951 Lebold
2,563,065 A 8/1951 Price
2,804,234 A 8/1957 Lachance
2,877,894 A 3/1959 Forrer
2,950,854 A 8/1960 Ganz
3,152,688 A 10/1964 Mahon
3,167,214 A 1/1965 Mahon
3,175,684 A 3/1965 Andre et al.
3,176,902 A 4/1965 Champlin
3,186,545 A 6/1965 Conrades
3,252,649 A 5/1966 Graser et al.
3,255,919 A 6/1966 Koolnis
3,257,066 A 6/1966 Williams
3,339,726 A 9/1967 Moore
3,355,012 A 11/1967 Weiss
3,367,557 A 2/1968 Farquhar
3,386,570 A * 6/1968 Lock ..... B65D 71/20 206/140
3,398,856 A 8/1968 Graser
3,416,654 A 12/1968 Plateringen
3,432,029 A 3/1969 Brown
3,635,452 A 1/1972 Helms
3,669,342 A 6/1972 Funkhouser
3,670,950 A 6/1972 Rossi
3,674,137 A 7/1972 Graser
3,679,121 A 7/1972 Morgese
3,687,282 A 8/1972 Owen
3,698,625 A * 10/1972 Graser ..... B65D 71/16 206/161
3,715,029 A 2/1973 Wood
3,744,704 A 7/1973 Struble
3,747,801 A 7/1973 Graser
3,767,042 A 10/1973 Ganz
3,797,729 A 3/1974 Holmes
3,820,657 A 6/1974 Klygis et al.
3,884,353 A 5/1975 Forte
3,921,895 A 11/1975 Ziche
3,942,631 A 3/1976 Sutherland et al.
3,963,121 A 6/1976 Kipp
3,977,518 A 8/1976 Arneson
4,034,852 A 7/1977 Forrer
4,056,223 A 11/1977 Williams
4,093,068 A 6/1978 Smrt
4,101,069 A 7/1978 Wood
4,131,230 A 12/1978 Koehlinger et al.
4,146,168 A 3/1979 Hartline
4,186,867 A 2/1980 Wood
4,192,540 A 3/1980 Oliff
4,202,446 A 5/1980 Sutherland
4,234,081 A 11/1980 Champlin
4,256,226 A 3/1981 Stone
4,295,562 A 10/1981 Wood
4,324,328 A 4/1982 Champlin
4,328,891 A 5/1982 Elward
4,330,079 A 5/1982 Wood
4,382,505 A 5/1983 Sutherland et al.
4,394,903 A 7/1983 Bakx
4,398,631 A 8/1983 Graser
4,421,232 A 12/1983 Konaka
4,424,901 A 1/1984 Lanier
4,437,569 A 3/1984 Sorenson
4,437,606 A 3/1984 Graser
4,438,843 A 3/1984 Graser
4,463,852 A 8/1984 Stone
4,465,180 A 8/1984 Klygis
4,470,503 A 9/1984 Stone
4,498,582 A 2/1985 Tomassi et al.
4,498,618 A 2/1985 Sutherland
4,505,696 A 3/1985 Wright et al.
4,526,316 A 7/1985 Sutherland
4,533,047 A 8/1985 Calvert
4,545,485 A * 10/1985 Oliff ..... B65D 71/18 206/147
4,574,997 A 3/1986 Ikeda
4,597,523 A 7/1986 Schuster
4,600,140 A 7/1986 Milliens
4,601,390 A 7/1986 Rosenthal et al.
4,708,284 A 11/1987 Sutherland et al.
4,773,533 A 9/1988 Greene
4,804,089 A 2/1989 Wilson
4,875,586 A 10/1989 Chaussadas
4,883,168 A 11/1989 Dreyfus
4,890,737 A 1/1990 Kadleck et al.
4,890,738 A 1/1990 Carer
4,901,849 A 2/1990 Wilson
4,919,266 A 4/1990 McIntosh, Jr. et al.
4,925,019 A 5/1990 Ganz et al.
5,002,186 A 3/1991 Cooper
D316,672 S 5/1991 Wood
5,020,668 A 6/1991 Schuster
5,022,525 A 6/1991 Schuster
5,080,280 A 1/1992 Kraus
5,094,347 A 3/1992 Schuster
5,131,588 A 7/1992 Oliff
5,145,067 A 9/1992 Carver
5,158,177 A 10/1992 Negelen et al.
5,167,325 A 12/1992 Sykora
5,246,112 A 9/1993 Stout et al.
5,297,673 A 3/1994 Sutherland
5,310,050 A 5/1994 Sutherland
5,311,984 A 5/1994 Harris
5,328,080 A 7/1994 Holley, Jr.
5,360,104 A 11/1994 Sutherland
5,360,113 A 11/1994 Harris
5,385,234 A 1/1995 Stout et al.
5,390,784 A 2/1995 Sutherland
5,390,848 A 2/1995 Gungner et al.
5,437,363 A 8/1995 Gungner
5,439,112 A 8/1995 De Guglielmo et al.
5,443,203 A 8/1995 Sutherland
5,472,090 A 12/1995 Sutherland
5,476,217 A 12/1995 Moncrief et al.
5,485,915 A 1/1996 Harris
5,549,197 A * 8/1996 Sutherland ..... B65D 71/20 206/158
5,579,904 A 12/1996 Holley, Jr.
5,582,289 A 12/1996 Wright
5,595,291 A 1/1997 Negelen
5,595,292 A 1/1997 Bates
5,595,299 A 1/1997 LeBras
5,605,228 A 2/1997 Baxter
5,653,340 A 8/1997 Daniel
5,671,845 A 9/1997 Harris
5,699,957 A 12/1997 Blin et al.
5,765,685 A 6/1998 Roosa
5,775,572 A 7/1998 Oliff
5,941,389 A * 8/1999 Gomes ..... B65D 71/20 206/427
5,947,367 A 9/1999 Miller et al.
5,975,286 A 11/1999 Oliff
5,975,287 A 11/1999 Negelen
5,979,645 A 11/1999 Holley, Jr.
5,984,086 A 11/1999 Fousghee et al.

(56) References Cited

U.S. PATENT DOCUMENTS

| | | | | |
|---|---|---|---|---|
| 6,155,412 | A | 12/2000 | LeBras et al. | |
| 6,170,741 | B1 | 1/2001 | Skolik et al. | |
| 6,189,687 | B1 | 2/2001 | Bakx | |
| 6,213,297 | B1 | 4/2001 | Gale | |
| 6,223,892 | B1 | 5/2001 | Bakx | |
| 6,241,083 | B1 | 6/2001 | Harrelson | |
| 6,247,585 | B1 | 6/2001 | Holley, Jr. | |
| 6,273,330 | B1 | 8/2001 | Oliff et al. | |
| 6,295,789 | B1 | 10/2001 | Muller | |
| 6,315,111 | B1 | 11/2001 | Sutherland | |
| 6,315,123 | B1 | 11/2001 | Ikeda | |
| 6,527,108 | B1 * | 3/2003 | Blin | B65D 71/16 206/148 |
| 6,536,656 | B2 | 3/2003 | Auclair et al. | |
| 6,615,984 | B2 | 9/2003 | Saulas et al. | |
| 6,669,083 | B2 | 12/2003 | Bates | |
| 6,695,137 | B2 | 2/2004 | Jones et al. | |
| 6,877,600 | B2 | 4/2005 | Sutherland | |
| 6,896,130 | B2 | 5/2005 | Theelen | |
| 6,948,293 | B1 | 9/2005 | Eckermann et al. | |
| 6,983,874 | B2 | 1/2006 | Bakx | |
| 6,997,372 | B2 | 2/2006 | Gasparowicz | |
| 7,028,839 | B2 | 4/2006 | Belloli et al. | |
| 7,048,113 | B2 | 5/2006 | Gomes | |
| 7,063,208 | B2 | 6/2006 | Lebras | |
| 7,070,045 | B2 | 7/2006 | Theelen | |
| 7,134,547 | B2 | 11/2006 | Auclair | |
| 7,175,020 | B2 | 2/2007 | Sutherland et al. | |
| 7,222,777 | B2 | 5/2007 | Garnier | |
| 7,234,591 | B2 | 6/2007 | LeBras et al. | |
| 7,374,038 | B2 | 5/2008 | Smalley | |
| 7,427,010 | B2 | 9/2008 | Sutherland | |
| 7,467,729 | B2 | 12/2008 | Lown et al. | |
| 7,780,067 | B2 | 8/2010 | Holley, Jr. | |
| 7,900,815 | B2 | 3/2011 | Shmagin | |
| 7,913,844 | B2 | 3/2011 | Spivey, Sr. | |
| 8,061,587 | B2 | 11/2011 | Blin | |
| 8,070,052 | B2 | 12/2011 | Spivey, Sr. | |
| 8,424,677 | B2 | 4/2013 | Spivey, Sr. et al. | |
| 8,978,889 | B2 | 3/2015 | Fitzwater et al. | |
| 2004/0000494 | A1 | 1/2004 | Sutherland | |
| 2004/0164135 | A1 | 8/2004 | Gong et al. | |
| 2007/0056869 | A1 | 3/2007 | Tokarski | |
| 2007/0181658 | A1 | 8/2007 | Sutherland | |
| 2007/0215682 | A1 | 9/2007 | Bates et al. | |
| 2007/0277481 | A1 | 12/2007 | LeBras | |
| 2008/0203143 | A1 | 8/2008 | Holley | |
| 2008/0257942 | A1 | 10/2008 | LeBras | |
| 2009/0032425 | A1 | 2/2009 | Perkinson | |
| 2009/0065559 | A1 | 3/2009 | Parkes | |
| 2009/0101526 | A1 | 4/2009 | Sutherland et al. | |
| 2009/0236408 | A1 | 9/2009 | Spivey, Sr. et al. | |
| 2010/0140336 | A1 | 6/2010 | Ho Fung | |
| 2011/0011924 | A1 | 1/2011 | Spivey, Sr. et al. | |
| 2011/0065558 | A1 | 3/2011 | Smalley | |
| 2011/0233091 | A1 | 9/2011 | Block et al. | |
| 2011/0284622 | A1 | 11/2011 | Boukredine | |
| 2011/0290867 | A1 | 12/2011 | Schemmel et al. | |
| 2012/0279897 | A1 | 11/2012 | Schmal et al. | |
| 2012/0285854 | A1 | 11/2012 | Spivey, Sr. | |

FOREIGN PATENT DOCUMENTS

| | | | |
|---|---|---|---|
| EP | 0 170 490 | | 2/1986 |
| EP | 0 172 932 | | 3/1986 |
| EP | 0 332 153 | B1 | 9/1991 |
| EP | 0 630 825 | A2 | 12/1994 |
| EP | 0 901 969 | B1 | 4/2000 |
| EP | 1 065 151 | A1 | 1/2001 |
| EP | 1 151 935 | A2 | 11/2001 |
| EP | 1 348 638 | A1 | 10/2003 |
| EP | 1 103 481 | B1 | 8/2004 |
| EP | 1 010 637 | B1 | 9/2004 |
| EP | 1 125 858 | B1 | 9/2004 |
| EP | 1 381 545 | B1 | 10/2005 |
| EP | 1 334 043 | B1 | 12/2005 |
| EP | 1 513 737 | B1 | 11/2006 |
| EP | 2 055 648 | A1 | 5/2009 |
| EP | 1 749 755 | B1 | 12/2011 |
| EP | 2 673 213 | | 12/2013 |
| GB | 2 279 065 | A | 12/1994 |
| JP | 11-124129 | A | 5/1999 |
| JP | 3039805 | | 3/2000 |
| JP | 2008 213894 | A | 9/2008 |
| JP | 2009-120248 | | 6/2009 |
| KR | 20-2010-0010124 | | 10/2010 |
| WO | WO 92/09498 | | 6/1992 |
| WO | WO 93/14991 | | 8/1993 |
| WO | WO 95/08489 | A1 | 3/1995 |
| WO | WO 88/02607 | | 4/1998 |
| WO | WO 02/34639 | A1 | 5/2002 |
| WO | WO 2005/030604 | A1 | 4/2005 |
| WO | WO 2005/042370 | A1 | 5/2005 |
| WO | WO 2008/036754 | A2 | 3/2008 |
| WO | WO 2011/022145 | A1 | 2/2011 |
| WO | WO 2011/049947 | A1 | 4/2011 |
| WO | WO 2012/109627 | A1 | 8/2012 |
| WO | WO 2013/109844 | A1 | 7/2013 |

* cited by examiner

CARRIER FOR CONTAINERS

CROSS REFERENCE TO RELATED APPLICATIONS

This application claims the benefit of U.S. Provisional Patent Application No. 61/964,519, filed Jan. 7, 2014.

INCORPORATION BY REFERENCE

The disclosure of U.S. Provisional Patent Application No. 61/964,519, which was filed on Jan. 7, 2014, is hereby incorporated by reference for all purposes as if presented herein in its entirety.

BACKGROUND OF THE DISCLOSURE

The present disclosure generally relates to carriers for holding and displaying beverage containers and/or other types of articles.

SUMMARY OF THE DISCLOSURE

In general, one aspect of the disclosure is directed a carrier for holding a plurality of articles. The carrier comprises a plurality of panels that extends at least partially around an interior of the carton. The plurality of panels can comprise a first top panel, a second top panel, and a back panel. The first top panel can be foldably connected to the second top panel and the back panel, and the second top panel can be oblique with respect to the first top panel and the back panel. A crown retention feature can be in the back panel adjacent the first top panel for at least partially receiving a top portion of a first article of the plurality of articles. A crown receiving opening can be in the second top panel spaced apart from the first top panel for at least partially receiving a top portion of a second article of the plurality of articles so that the top portion of the second article extends at least partially through the crown receiving opening.

In another aspect, the disclosure is directed to a blank for forming a carrier for holding a plurality of articles. The blank comprises a plurality of panels comprising a first top panel, a second top panel, and a back panel. The first top panel can be foldably connected to the second top panel and the back panel, and the second top panel can be for being positioned to be oblique with respect to the first top panel and the back panel when the carrier is formed from the blank. A crown retention feature can be in the back panel adjacent the first top panel for at least partially receiving a top portion of a first article of the plurality of articles when the carrier is formed from the blank. A crown receiving opening can be in the second top panel spaced apart from the first top panel for at least partially receiving a top portion of a second article of the plurality of articles so that the top portion of the second article extends at least partially through the crown receiving opening when the carrier is formed from the blank.

In another aspect, the disclosure is directed to a method of forming a carrier holding a plurality of articles. The method comprises obtaining a blank comprising a plurality of panels comprising a first top panel, a second top panel, and a back panel, a crown retention feature in the back panel adjacent the first top panel, and a crown receiving opening in the second top panel spaced apart from the first top panel. The first top panel can be foldably connected to the second top panel and the back panel. The method further can comprise disposing the first top panel and the second top panel over a respective first article and second article of the plurality of articles. The crown receiving opening can be generally aligned with the second article. The method also can comprise forming an interior of the carrier by folding the plurality of panels at least partially around the plurality of articles. The folding the panels can comprise folding the back panel with respect to the first top panel so that a top portion of the first article is at least partially received by the crown retention feature. The folding the panels further can comprise folding the second top panel to be oblique with respect to the first top panel and the back panel so that a top portion of the second article extends at least partially through the crown receiving opening.

Other aspects, features, and details of the present disclosure can be more completely understood by reference to the following detailed description of exemplary embodiments taken in conjunction with the drawings and from the appended claims.

Those skilled in the art will appreciate the above stated advantages and other advantages and benefits of various additional embodiments reading the following detailed description of the embodiments with reference to the below-listed drawing figures. Further, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to various features for cartons or carriers that contain articles such as containers, bottles, cans, etc. The articles can be used for packaging food and beverage products, for example. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons or carriers according to the present disclosure can accommodate articles of any shape. For the purpose of illustration and not for the purpose of limiting the scope of the disclosure, the following detailed description describes beverage containers (e.g., aluminum beverage bottles) as disposed within the carrier embodiments. In this specification, the terms "inner," "interior," "outer," "exterior," "front," "back," "rear," "lower," "bottom," "upper," and "top" indicate orientations determined in relation to fully erected and upright cartons.

Figure 1:
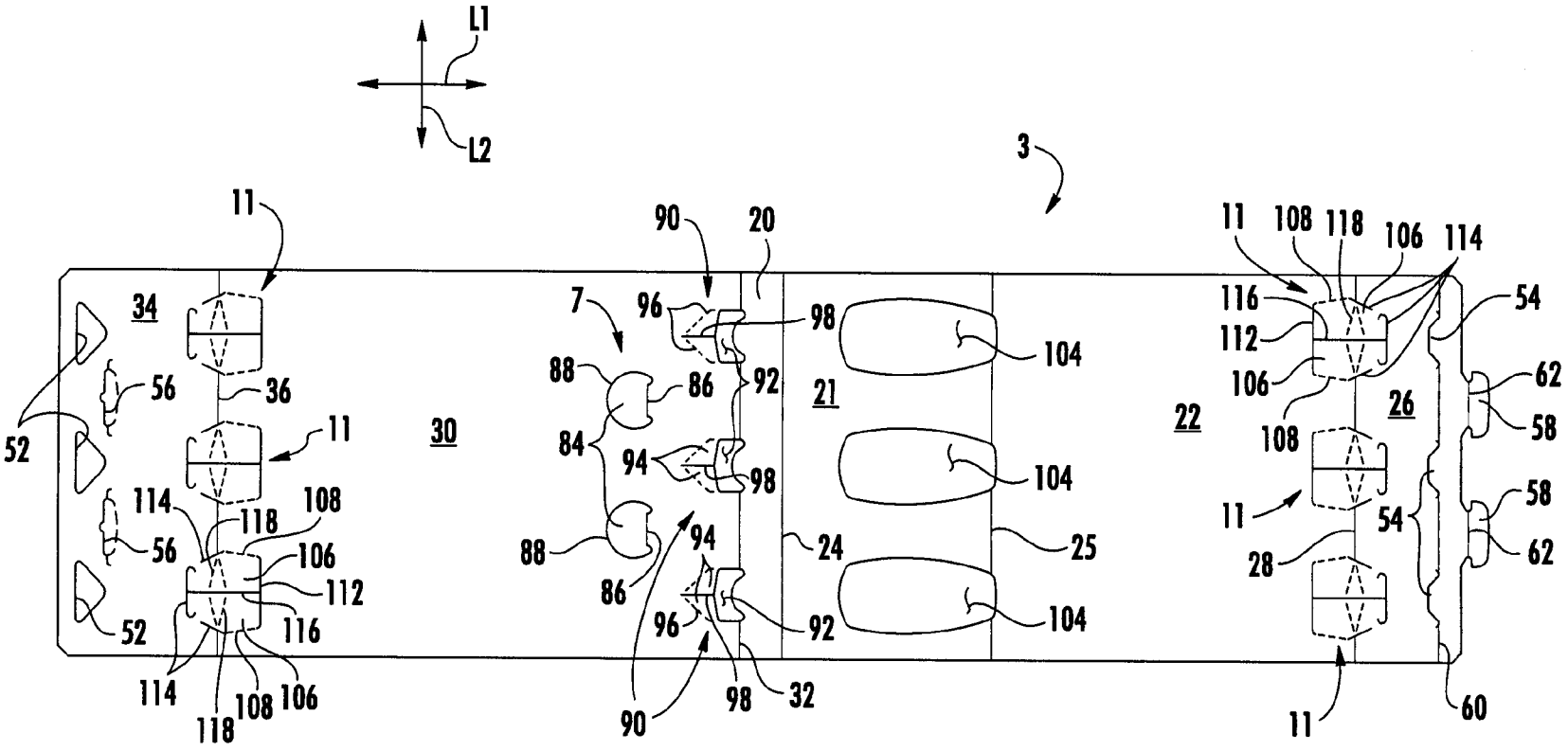
FIG. 1 is a plan view of an exterior surface of a blank used to form a carrier according to a first embodiment of the disclosure.
Figure 2:
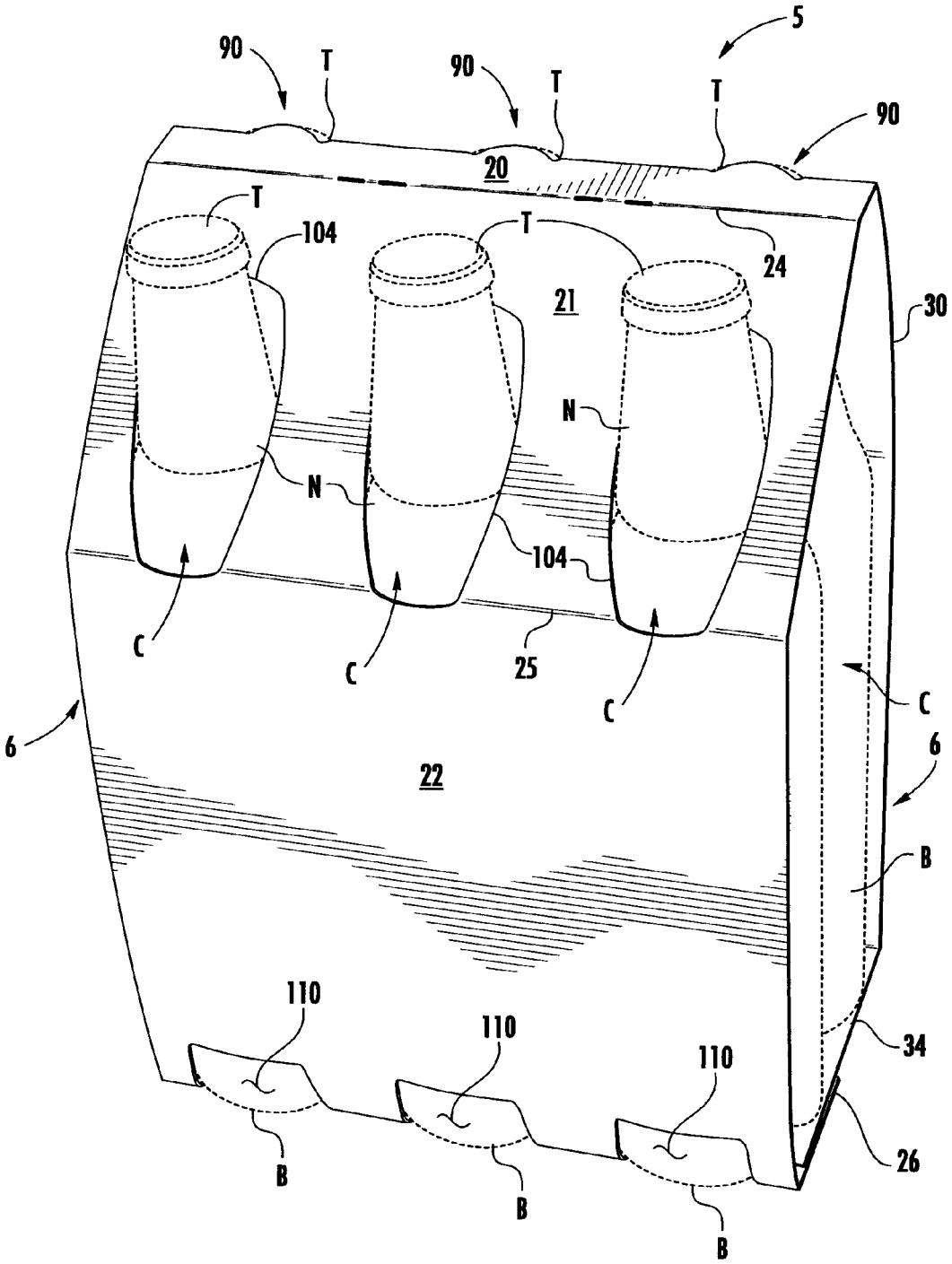
FIG. 2 is a front perspective view of the assembled carrier and containers according to the first embodiment of the disclosure.
Figure 3:
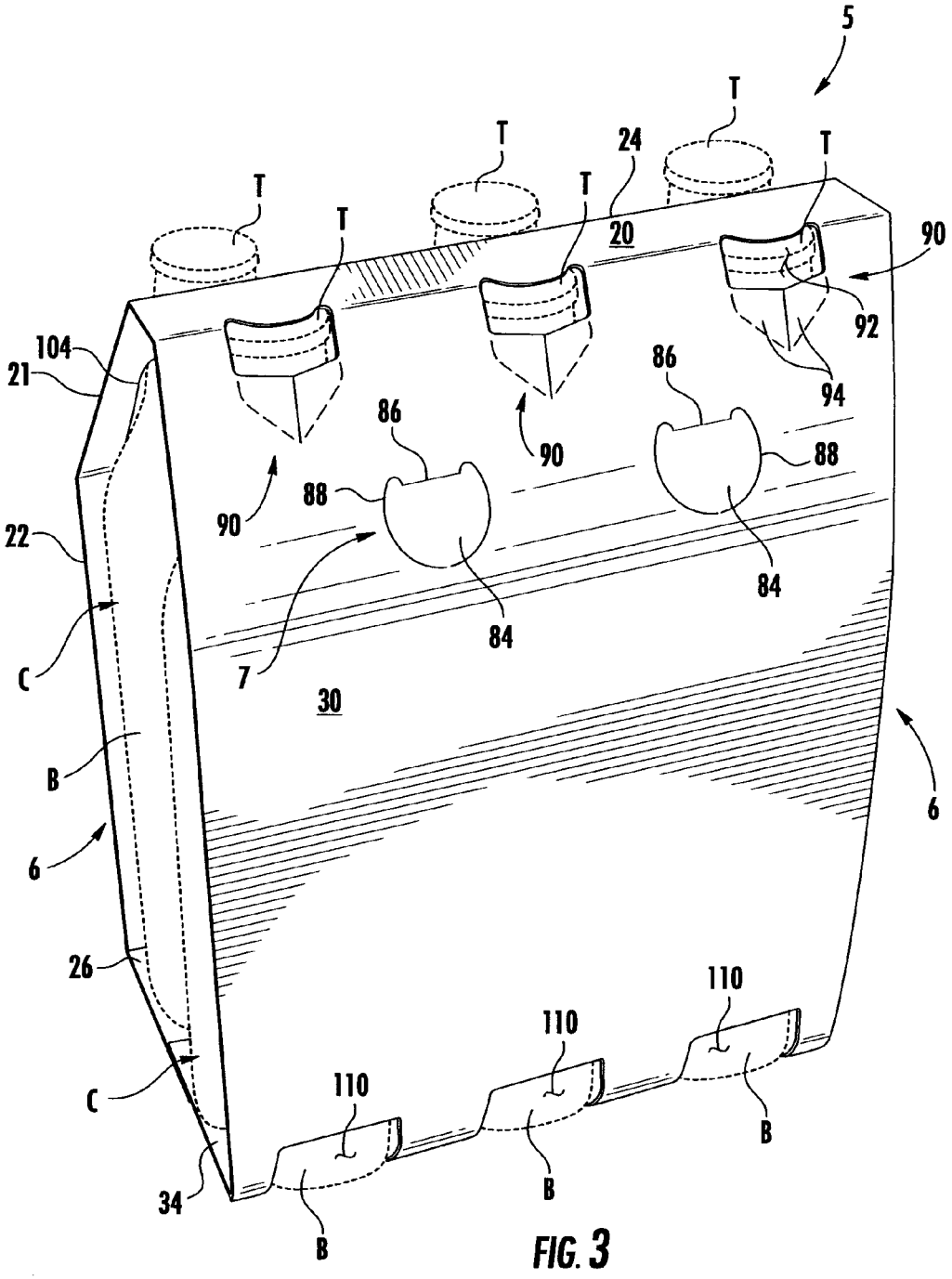
FIG. 3 is a rear perspective view of the carrier and containers of FIG. 2.

FIG. 1 is a plan view of an exterior surface of a blank 3, used to form a carrier 5 (FIGS. 2 and 3) according to a first embodiment of the disclosure. The carrier 5 can be used to house a plurality of articles such as containers C (FIGS. 2 and 3). In the illustrated embodiment, the containers C are beverage bottles and the carrier 5 is sized to house six containers in a single layer in a 2×3 arrangement, but it is understood that the carrier 5 may be sized and shaped to hold containers C of a different or same quantity in more than one layer and/or in different row/column arrangements (e.g., 1×6, 2×6, 2×4, 2×2, 2×6×2, 2×4×2, 2×9, etc.). In the illustrated embodiment, the carrier 5 can include bottom retention features 11 for engaging the bottom portions B of the containers C. In addition, the carrier 5 can include a handle, generally indicated at 7, for grasping and carrying the carrier.

In the illustrated embodiment, the carrier 5 is a carrier having generally open sides or ends 6 (FIGS. 2 and 3) that wraps around the containers C (e.g., the carrier 5 may be referred to as a wrap-around carton). The carrier 5 could be otherwise configured, shaped and/or arranged. For example, the sides 6 could be at least partially closed such as by end flaps or other closing mechanisms.

The blank 3 has a longitudinal axis L1 and a lateral axis L2. In the illustrated embodiment, the blank 3 comprises a first top panel 20 foldably connected to a second top panel 21 at a first lateral fold line 24, a front panel 22 foldably connected to the second top panel 21 at a second lateral fold line 25, a first bottom panel 26 foldably connected to the front panel 22 at a third lateral fold line 28, a back panel 30 foldably connected to the top panel 20 at a fourth lateral fold line 32, and a second bottom panel 34 foldably connected to the back panel 30 at a fifth lateral fold line 36.

The second bottom panel 34 includes cutouts forming primary female locking edges 52 that are shaped and positioned to engage respective primary male locking tab projections 54 on the first bottom panel 26. The second bottom panel 34 also includes slits 56 shaped and positioned to receive outer secondary locking tab projections 58 of the first bottom panel 26. The first bottom panel 26 includes a lateral fold line 60, which is interrupted by the slits that define the primary male locking tab projections 54. In addition, each of the secondary locking tab projections 58 can include a lateral fold line 62. Although the locking elements of the blank 3 are illustrated to demonstrate a particular bottom panel locking arrangement suitable for use with the carrier 5 (FIGS. 2 and 3), it is understood that any alternative form of bottom panel locking structure may be employed without departing from the disclosure.

As shown in FIG. 1, the handle 7 includes two finger flaps 84 (e.g., handle flaps), each respectively formed by slits or cuts and foldably attached to the back panel 30 at a respective lateral fold line 86. In one embodiment, the lateral fold lines 86 generally can be collinear with one another. The finger flaps 84 can be separable from the back panel 30 along respective cuts 88. One or more nicks or other gaps in the cuts 88 can be included to help retain the finger flaps 84 generally in the plane of the back panel 30 until the finger flaps 84 are folded inwardly to actuate the handle 7. The handle 7 could include other features for carrying the carrier 5, the finger flaps 84 could be otherwise configured, positioned, shaped, and/or arranged, or the handle 7 could be omitted from the carrier without departing from the disclosure. For example, in alternative embodiments, the handle could include one or both of the flaps 84 could be replaced by a respective opening, or the handle could include one or more elongate openings and/or flaps.

As shown in FIG. 1, the blank 3 can include crown retention features 90 in the back panel 30 adjacent the first top panel 20. In one embodiment, the crown retention features 90 include openings 92 adjacent a respective edge of the first top panel 20 and retaining flaps 94 foldably connected to the back panel 30 along a respective oblique fold line 96. The flaps 94 of each of the crown retention features 90 can be separable along a tear or cut line 98, and the flaps 94 can be disposed adjacent the respective opening 92. When the carrier 5 is formed around the containers C, the crowns T (e.g., a cap of a bottle) can be at least partially received in each of the openings 92, and the flaps 94 can engage the container adjacent the cap. In the illustrated embodiment, the blank 3 can include three crown retention features 90 in the back panel 30, one for each of the containers C in a back row (e.g., a row adjacent the back panel 30). Any of the crown retention features 90 could be otherwise configured, positioned, shaped, and/or arranged, or could be omitted from the carrier without departing from the disclosure. For example, any suitable number of crown retention features could be included, including a different number of crown retention features and containers C in a respective row.

As shown in FIG. 1, three crown openings 104 can extend in the second top panel 21 adjacent the front panel 22. In the illustrated embodiment, the crown openings 104 can be spaced apart from the first top panel 20 and can be defined by an edge of the front panel 22 and a generally U-shaped edge of the second top panel 21 extending from the edge of the front panel 22. When the carrier 5 is formed, the crowns T and/or necks N of respective containers C in the front row (e.g., the row of containers C adjacent the front panel 22) can be at least partially received by the crown openings 104 (FIG. 7), which can display labels on the top portions of the containers C and/or can provide a distinctive look for the package. Any of the crown openings 104 could be otherwise configured, positioned, shaped, and/or arranged, or could be omitted from the carrier without departing from the disclosure. For example, any suitable number of crown openings could be included, including a different number of crown openings and containers C in a respective row.

In the illustrated embodiment, each of the bottom retention features 11 can include two heel lock flaps 106 foldably connected to the front panel 22 or the back panel 30 along respective oblique fold lines 108. The heel lock flaps 106 can be separable from the front panel 22 or the back panel 30 along respective lateral cuts 112 and can be separable from the respective bottom panels 26, 34 along cuts 114. In one embodiment, the heel lock flaps 106 in each of the bottom retention features 11 can be separable from one another along a longitudinal cut 116, and each of the heel lock flaps 106 can be foldable along a generally V-shaped fold line 118 that is generally aligned with the lateral fold line 28 or the lateral fold line 36. Accordingly, the heel lock flaps 106 can be folded inwardly to form heel lock openings 110 (FIGS. 2 and 3) when the carrier 5 is formed. In the illustrated embodiment, there are three bottom retention features 11 in each of the front panel 22 and the back panel 30, one for each of the containers C in the front and back rows. Any of the bottom retention features 11, including at least the heel lock flaps 106 and/or the heel lock openings 110, could be otherwise configured, positioned, shaped, and/or arranged, or could be omitted from the carrier without departing from the disclosure. For example, any suitable number of bottom retention features could be included, including a different number of bottom retention features and containers C in a respective row. Additionally, in an exemplary alternative embodiment, the heel lock flaps 106 could be omitted so that the heel lock openings 110 extend in the blank prior to forming the carrier.

In the illustrated embodiment, the carrier 5 can be erected by wrapping the blank 3 around the containers C and interlocking the first and second bottom panels 26, 34. For example, the containers C can be arranged in the front and back rows (FIGS. 2 and 3) and the first top panel 20 can be placed on top of the containers C in the back row so that the crown retention features 90 are generally aligned with the containers C in the back row. The second top panel 21 can be folded downwardly along the lateral fold line 24 over the containers C in the front row so that the crowns T and at least a portion of the necks N extend through the crown openings 104 (FIG. 2). The front panel 22 can be further folded downwardly along the lateral fold line 25 so that the front panel 22 is positioned against the containers C in the front row and so that the front panel 22 is generally vertical (FIG. 2). The first bottom panel 26 can be folded along the lateral fold line 28 to extend generally under the containers C. The back panel 30 can be downwardly folded along the lateral fold line 32 (e.g., in one embodiment, at the same time or nearly at the same time as the second top panel 21 and the front panel 22 are folded) so that the crowns T of the containers C in the back row are at least partially retained in respective the crown retaining features 90 and the back panel 30 extends generally downwardly from the first top panel 20 (FIG. 3). In the illustrated embodiment, the back panel 30 generally can be curved to accommodate the shoulders of the containers between the bottom portions B of the containers and the narrower necks N (FIGS. 2 and 3). The second bottom panel 34 can be folded along the lateral fold line 36 to extend generally under the containers C.

In one embodiment, the bottom panels 26, 34 can be at least partially overlapped (e.g., the second bottom panel 34 can generally overlap the first bottom panel 26) (FIGS. 2 and 3), and the locking tabs 54 can be engaged with the locking edges 52. The locking flaps 58 then can be inserted into and engaged with the slits 56 to further interlock the bottom panels 26, 34. The bottom retention features 11 can be actuated (e.g., by pushing the heel lock flaps 106 inwardly) to engage the bottoms B of the containers C and to form the heel lock openings 110 for at least partially receiving the bottoms B of the containers C. The carrier 5 could be alternatively erected and/or loaded with containers C without departing from the disclosure.

In the illustrated embodiment, the crown retention features 90 and the bottom retention features 11 in the back panel 30 can cooperate to help retain the containers C in the back row in the carrier 5. Additionally, the crown openings 104 and the bottom retention features 11 in the second top panel 21 and the front panel 22 can cooperate to help retain the containers C in the front row in the carrier 5. Additionally, since the neck portions N of the containers C in the front row extend at least partially through the crown openings in the second top panel 21, the labels on the neck portions N can be more easily seen when the package (e.g., the carrier 5 holding the containers C) is on display.

In the illustrated embodiment, the handle 7 (FIG. 3) can be actuated to carry and/or hold the package by folding the finger flaps 84 inwardly along the respective lateral fold lines 86 and inserting fingers into the resulting openings (not shown) to grasp the carrier 5 at the back panel 30. As shown in FIG. 3, each of the finger flaps 84 can be generally aligned between two neck portions N of respective containers C in the back row. Accordingly, when the finger flaps 84 are folded inwardly (not shown), the finger flaps 84 can extend between the respective neck portions. The handle 7 could be alternatively actuated and/or the carrier 5 could be alternatively held and/or carried without departing from the disclosure.

In one embodiment, the carrier 5 can be considered an asymmetric carrier since the carrier 5 is different adjacent the front row versus the back row of containers C (e.g., the carrier is configured differently adjacent the back row than it is configured adjacent the front row). For example, the first top panel 20 extends generally horizontally over the containers C in the back row, and the back panel 30 extends generally downwardly from the first top panel 20. In contrast, the second top panel 21 extends generally downwardly and obliquely from the first top panel 20 so that the containers C in the front row extend partially through the second top panel 21. Accordingly, the carrier 5 and the resulting package can have a distinctive look when on display, and the carrier 5 can display certain aspects of the front containers while retaining all the containers and providing a convenient way to carrier the carrier 5 (e.g., at the handle 7 in the back panel 30). The carrier 5, the containers C, and/or the package could be otherwise configured, positioned, shaped, and/or arranged without departing from the disclosure.

Figure 4:
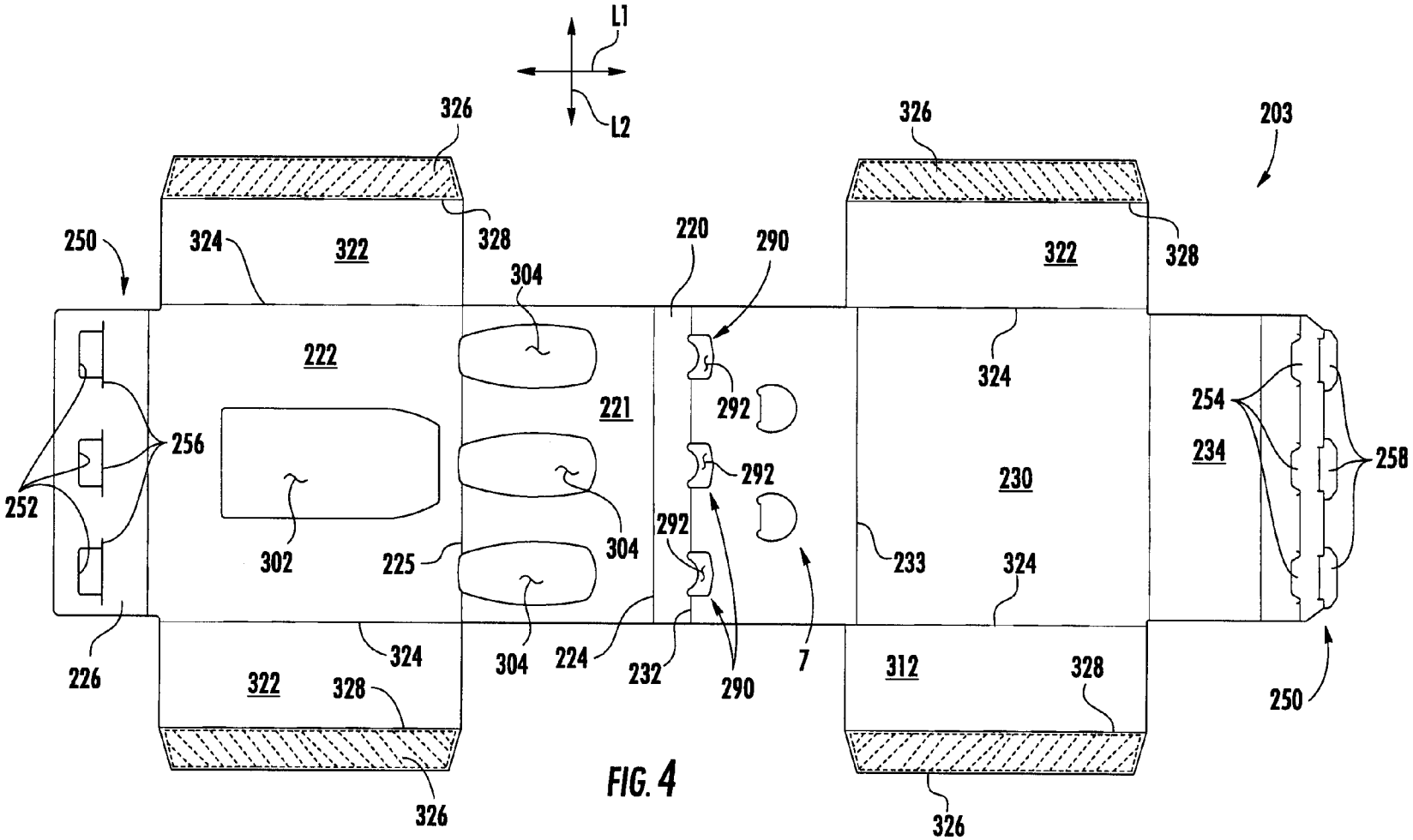
FIG. 4 is a plan view of an exterior surface of a blank used to form a carrier according to a second embodiment of the disclosure.
Figure 5:
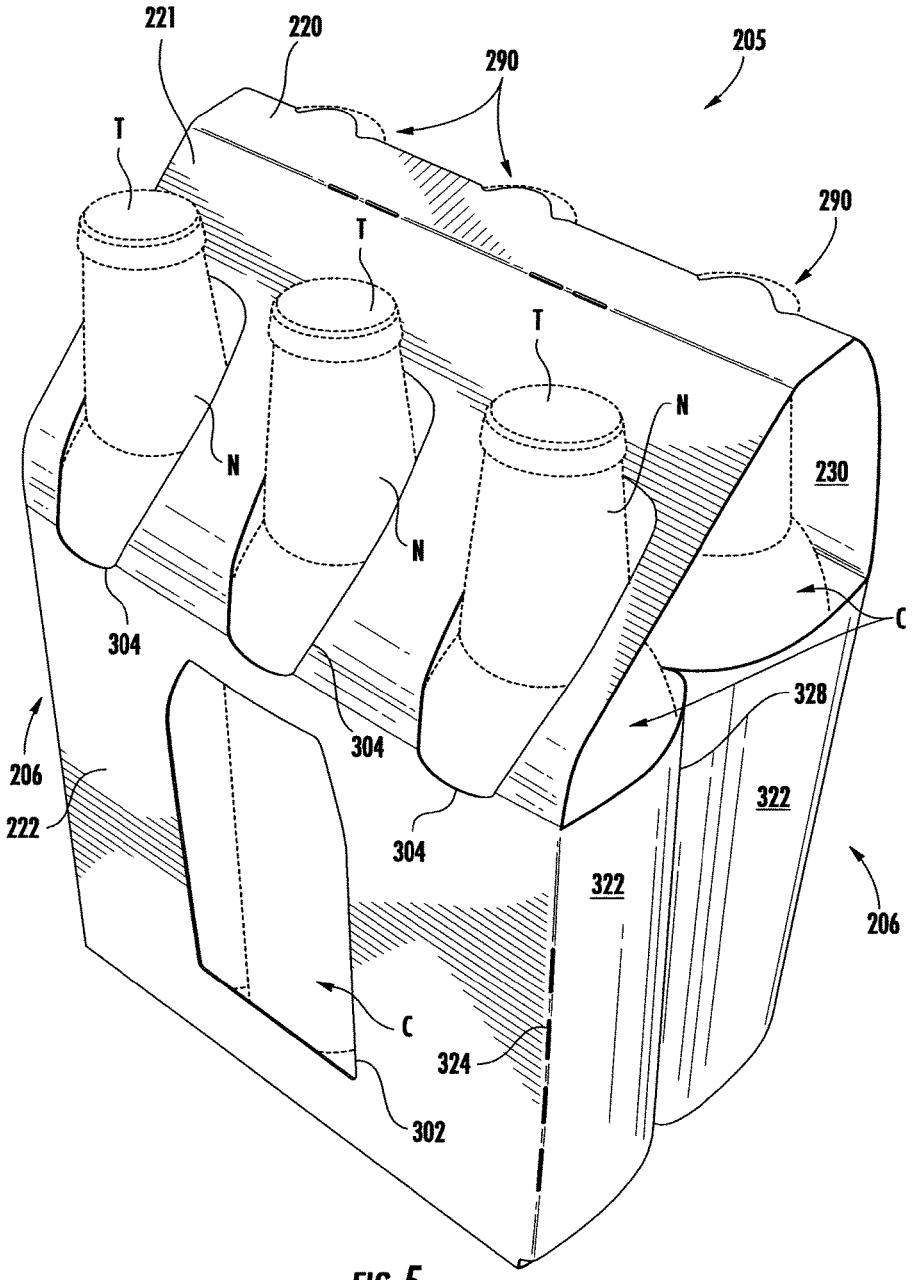
FIG. 5 is a front perspective view of the assembled carrier and containers according to the second embodiment of the disclosure.
Figure 6:
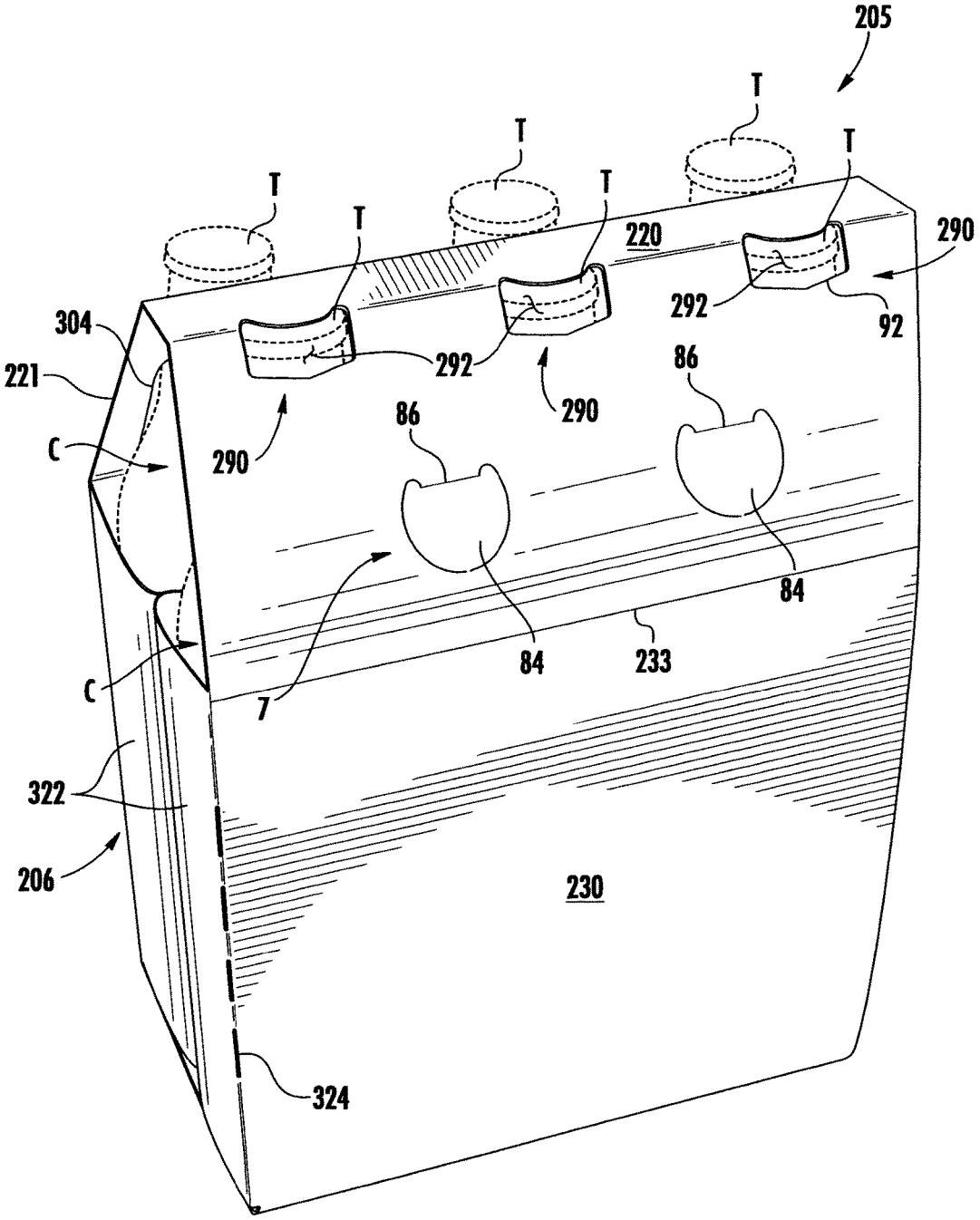
FIG. 6 is a rear perspective view of the carrier and containers of FIG. 5.

FIG. 4 is a plan view of a blank 203 for forming a carrier 205 (FIGS. 5 and 6) according to a second embodiment of the disclosure. The second embodiment is generally similar to the first embodiment, except for variations noted and variations that will be apparent to one of ordinary skill in the art. Accordingly, similar or identical features of the embodiments have been given like or similar reference numbers. As shown in FIG. 4, the blank 203 includes a first top panel 220 foldably connected to a second top panel 221 and a back panel 230. As shown in FIGS. 4 and 6, the back panel 230 can include an intermediate lateral fold line 233 so that an upper portion of the back panel 230 can more easily bend around the shoulders of the containers, for example. The handle 7 can extend in the upper portion of the back panel 230 in the illustrated embodiment. Alternatively, the handle 7 could be positioned in another portion of the back panel 230 or the blank 203. The handle 7 could be omitted or could be otherwise positioned, shaped, arranged, and/or configured without departing from the disclosure.

As shown in FIG. 4, the crown retention features 290 can be formed in the back panel 230 adjacent the first top panel 220 similarly to the crown retention features 90 of the first embodiment. In the illustrated embodiment, the crown retention features 290 include respective openings 292 and do not include retaining flaps (e.g., retaining flaps 94 of the first embodiment). The crown retention features 290 could be omitted or could be otherwise positioned, shaped, arranged, and/or configured without departing from the disclosure.

In the illustrated embodiment, the blank 203 can include display features for at least one of the containers C. The display features can include an aperture or window 302 extending in front panel 222. In one embodiment, the window 302 can be aligned with a container C (e.g., a container in the middle of the front row), and the container C can be oriented so that the label of the container C is visible through the window 302. Additionally, as shown in FIGS. 4 and 5, crown openings 304 can extend in the second top panel 221. The crown openings 304 can be generally the same as the crown openings 104 in the first embodiment. The display features, including the window 302 and/or any of the crown openings 304, could be omitted or could be otherwise positioned, shaped, arranged, and/or configured without departing from the disclosure.

As shown in FIG. 4, the blank 203 can include alternative locking features 250 in the bottom panels 226, 234 that are generally similar to the locking features of the first embodiment. Accordingly, the bottom panels 226, 234 can be interlocked similarly to the locking features of the first embodiment. As shown in FIG. 4, the locking features 250 can include locking tabs 254 that can engage locking edges 252 and locking flaps 258 that can engage slits 256. The locking features 250 could be omitted or could be otherwise positioned, shaped, arranged, and/or configured without departing from the disclosure.

In the illustrated embodiment, as shown in FIG. 4, the blank 203 can include two side panels 322 foldably connected to each of the front panel 222 and the back panel 230 along respective longitudinal fold lines 324. An attachment flap 326 can be foldably connected to each of the side panels 322 along respective longitudinal fold lines 328. When the carrier 205 (FIGS. 5 and 6) is formed from the blank 203, the side panels 322 can be folded over the ends or sides 206 of the carrier 205, and the attachment flaps 326 can be glued in face-to-face contact with one another to at least partially close the sides 206 of the carrier 205 (FIGS. 5 and 6). In one embodiment, the attachment flaps 326 can be disposed between the two rows of containers C. Additionally, as shown in FIGS. 5 and 6, the side panels 322 can be curved (e.g., to at least partially conform to the containers C). Accordingly, the side panels 322 can help retain the containers C in the carrier 205. The blank 203 and/or the carrier 205 could be otherwise positioned, shaped, arranged, and/or configured without departing from the disclosure.

Any of the features of the various embodiments of the disclosure can be combined with, replaced by, or otherwise configured with other features of other embodiments of the disclosure (and/or the disclosures that have been incorporated by reference) without departing from the scope of this disclosure. Further, it is noted that the features of the blanks, and/or carriers of the various embodiments can be incorporated into a carton having any carton style or panel configuration. The carrier/carton styles and panel configurations described above are included by way of example.

In general, the blanks according to the present disclosure can be constructed from paperboard having a caliper so that it is heavier and more rigid than ordinary paper. The blanks can also be constructed of other materials, such as cardboard, or any other material having properties suitable for enabling the carton to function at least generally as described above. The blanks can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for holding a plurality of articles, the carrier comprising:

a plurality of panels that extends at least partially around an interior of the carton, the plurality of panels comprising a first top panel, a second top panel, and a back panel, the first top panel being foldably connected to the second top panel and the back panel, the second top panel being planar and oblique with respect to the first top panel and the back panel;

a crown retention feature in the back panel adjacent the first top panel for at least partially receiving a top portion of a first article of the plurality of articles; and a crown receiving opening in the second top panel spaced apart from the first top panel for at least partially receiving a top portion of a second article of the plurality of articles so that the top portion of the second article extends at least partially through the crown receiving opening.

2. The carrier of claim 1, wherein the back panel extends downwardly from the first top panel.

3. The carrier of claim 2, further comprising a handle disposed in the back panel and spaced apart from the first top panel.

4. The carrier of claim 1, further comprising a handle disposed in the back panel.

5. The carrier of claim 4, wherein the handle comprises a first handle flap and a second handle flap each foldably connected to the back panel.

6. The carrier of claim 5, wherein the first top panel is foldably connected to the back panel along a first fold line and the first handle flap and the second handle flap are foldably connected to the back panel along a respective second fold line and third fold line that are generally parallel to the first fold line.

7. The carrier of claim 5, wherein the first handle flap and the second handle flap are foldably connected to the back panel along respective fold lines that are generally collinear with one another.

8. The carrier of claim 1, wherein the plurality of panels comprises a front panel foldably connected to the second top panel, the crown receiving opening extending adjacent the front panel.

9. The carrier of claim 8, wherein the second top panel is oblique with respect to the front panel.

10. The carrier of claim 8, further comprising a first bottom panel foldably connected to the front panel and a second bottom panel foldably connected to the back panel, the first bottom panel being at least partially interlocked with the second bottom panel.

11. The carrier of claim 1, wherein the crown retention feature comprises a first retaining flap and a second retaining flap each foldably connected to the back panel adjacent a retaining opening, and the top portion of the first article is for being at least partially received in the retaining opening and is for being at least partially retained by the first retaining flap and the second retaining flap.

12. The carrier of claim 11, wherein an edge of the first top panel extends adjacent the retaining opening.

13. The carrier of claim 11, wherein each of the first retaining flap and the second retaining flap is foldably connected to the back panel along a respective oblique fold line, and the first retaining flap and the second retaining flap are at least partially separable from one another along a line of weakening.

14. The carrier of claim 1, further comprises a first side panel and a second side panel each foldably connected to the back panel and extending at least partially across a respective first side and second side of the carrier.

15. The carrier of claim 14, further comprising a front panel foldably connected to the second top panel, and a third side panel and a fourth side panel each foldably connected to the front panel and extending at least partially across the respective first side and second side of the carrier.

16. The carrier of claim 1, further comprising a front panel foldably connected to the second top panel, a first side panel foldably connected to the back panel, a first attachment flap foldably connected to the first side panel, a second side panel foldably connected to the front panel, and a second attachment flap foldably connected to the second side panel, wherein the first attachment flap is attached at least partially in face-to-face contact with the second attachment flap, and the first side panel and the second side panel extend at least partially across a side of the carrier.

17. The carrier of claim 1, wherein the plurality of articles comprises a back row of articles including the first article and a front row of articles including the second article, and the carrier is asymmetric so that the carrier is configured differently adjacent the back row than the carrier is configured adjacent the front row.

18. A blank for forming a carrier for holding a plurality of articles, the blank comprising:

a plurality of panels comprising a first top panel, a second top panel, and a back panel, the first top panel being foldably connected to the second top panel and the back panel, the second top panel is for being positioned to be planar and oblique with respect to the first top panel and the back panel when the carrier is formed from the blank;

a crown retention feature in the back panel adjacent the first top panel for at least partially receiving a top portion of a first article of the plurality of articles when the carrier is formed from the blank; and a crown receiving opening in the second top panel spaced apart from the first top panel for at least partially receiving a top portion of a second article of the plurality of articles so that the top portion of the second article extends at least partially through the crown receiving opening when the carrier is formed from the blank.

19. The blank of claim 18, further comprising a handle disposed in the back panel.

20. The blank of claim 19, wherein the handle is spaced apart from the first top panel.

21. The blank of claim 19, wherein the handle comprises a first handle flap and a second handle flap each foldably connected to the back panel.

22. The blank of claim 21, wherein the first top panel is foldably connected to the back panel along a first fold line and the first handle flap and the second handle flap are foldably connected to the back panel along a respective second fold line and third fold line that are generally parallel to the first fold line.

23. The blank of claim 21, wherein the first handle flap and the second handle flap are foldably connected to the back panel along respective fold lines that are generally collinear with one another.

24. The blank of claim 18, wherein the plurality of panels comprises a front panel foldably connected to the second top panel, the crown receiving opening extending adjacent the front panel.

25. The blank of claim 24, further comprising a first bottom panel foldably connected to the front panel and a second bottom panel foldably connected to the back panel, the first bottom panel for being at least partially interlocked with the second bottom panel when the carrier is formed from the blank.

26. The blank of claim 18, wherein the crown retention feature comprises a first retaining flap and a second retaining flap each foldably connected to the back panel adjacent a retaining opening.

27. The blank of claim 26, wherein an edge of the first top panel extends adjacent the retaining opening.

28. The blank of claim 26, wherein each of the first retaining flap and the second retaining flap is foldably connected to the back panel along a respective oblique fold line, and the first retaining flap and the second retaining flap are at least partially separable from one another along a line of weakening.

29. The blank of claim 18, further comprises a first side panel and a second side panel each foldably connected to the back panel for extending at least partially across a respective first side and second side of the carrier formed from the blank.

30. The blank of claim 29, further comprising a front panel foldably connected to the second top panel, and a third side panel and a fourth side panel each foldably connected to the front panel for extending at least partially across the respective first side and second side of the carrier formed from the blank.

31. The blank of claim 18, further comprising a front panel foldably connected to the second top panel, a first side panel foldably connected to the back panel, a first attachment flap foldably connected to the first side panel, a second side panel foldably connected to the front panel, and a second attachment flap foldably connected to the second side panel, wherein the first attachment flap is for being attached at least partially in face-to-face contact with the second attachment flap when the carrier is formed from the blank.

32. A method of forming a carrier holding a plurality of articles, the method comprising:

obtaining a blank comprising a plurality of panels comprising a first top panel, a second top panel, and a back panel, a crown retention feature in the back panel adjacent the first top panel, and a crown receiving opening in the second top panel spaced apart from the first top panel, wherein the first top panel is foldably connected to the second top panel and the back panel;

disposing the first top panel and the second top panel over a respective first article and second article of the plurality of articles, the crown receiving opening being generally aligned with the second article;

forming an interior of the carrier by folding the plurality of panels at least partially around the plurality of articles, the folding the plurality of panels comprising folding the back panel with respect to the first top panel so that a top portion of the first article is at least partially received by the crown retention feature, and the folding the plurality of panels comprising folding the second top panel to be planar and oblique with respect to the first top panel and the back panel so that a top portion of the second article extends at least partially through the crown receiving opening.

33. The method of claim 32, wherein the blank further comprises a front panel foldably connected to the second top panel, and the folding the plurality of panels further comprises folding the back panel and the front panel to extend generally downwardly from the respective first top panel and second top panel.

34. The method of claim 32, wherein the blank further comprises a handle formed in the back panel.

35. The method of claim 32, wherein the crown retention feature comprises an opening in at least the back panel, and the folding the back panel causes at least a portion of the top portion of the first article to be received in the opening.

36. The method of claim 32, wherein the blank further comprises a front panel foldably connected to the second top panel, a first side panel foldably connected to the back panel, a first attachment flap foldably connected to the first side panel, a second side panel foldably connected to the front panel, and a second attachment flap foldably connected to the second side panel, and the method further comprises positioning the first side panel and the second side panel to extend at least partially across a side of the carrier between the front panel and the back panel, and attaching the first attachment flap at least partially in face-to-face contact with the second attachment flap.

37. The method of claim 32, wherein the plurality of articles comprises a back row of articles including the first article and a front row of articles including the second article, and the folding the plurality of panels comprises arranging the carrier to be asymmetric so that the carrier is configured differently adjacent the back row than it is configured adjacent the front row.

38. The carrier of claim 8, wherein the front panel and the back panel are planar and generally parallel.

39. The carrier of claim 38, wherein the back panel has a greater vertical height than the front panel.

40. The carrier of claim 8, wherein the front panel is foldably connected to the second top panel at a first fold line and the second top panel is foldably connected to the first top panel at a second fold line, the crown receiving opening is defined by an edge extending around an entire perimeter of the crown receiving opening, the edge extends from the first fold line and is spaced apart from the second fold line.

41. The blank of claim 24, wherein the front panel and the back panel are planar and are for being positioned in a generally parallel relationship in the carrier formed from the blank.

42. The blank of claim 41, wherein the back panel is sized to have a greater vertical height than the front panel in the carrier is formed from the blank.

43. The blank of claim 24, wherein the front panel is foldably connected to the second top panel at a first fold line and the second top panel is foldably connected to the first top panel at a second fold line, the crown receiving opening is defined by an edge extending around an entire perimeter of the crown receiving opening, the edge extends from the first fold line and is spaced apart from the second fold line.

* * * * *